United States Patent [19]

Noren

[11] 4,047,020

[45] Sept. 6, 1977

[54] DISGUISED EMERGENCY LIGHT

[75] Inventor: Don W. Noren, Redwood City, Calif.

[73] Assignee: Noren Products, Inc., Redwood City, Calif.

[21] Appl. No.: 626,494

[22] Filed: Oct. 28, 1975

[51] Int. Cl.[2] ..... F21V 9/08

[52] U.S. Cl. ..... 240/46.59; 240/41 R; 240/46.49 R; 340/366 B

[58] Field of Search ..... 240/41 R, 46.49 R, 46.51, 240/46.55, 46.57, 46.59; 340/366 B, 366 E, 383; 350/101

[56] References Cited

U.S. PATENT DOCUMENTS

| | | | |
|---|---|---|---|
| 1,583,507 | 5/1926 | Van Bloem | 340/383 |
| 1,642,993 | 9/1927 | Hainline | 240/46.57 X |
| 1,709,951 | 4/1929 | Richardson | 240/46.51 X |
| 2,170,552 | 8/1939 | De Porter | 240/46.51 X |
| 2,367,444 | 1/1945 | Stam | 240/46.49 R X |
| 2,744,209 | 5/1956 | Ferguson | 240/46.49 R X |
| 2,907,249 | 10/1959 | Hjermstad | 350/101 |
| 3,514,589 | 5/1970 | Huber | 240/46.39 |

FOREIGN PATENT DOCUMENTS

| | | | |
|---|---|---|---|
| 380,562 | 9/1932 | United Kingdom | 240/46.51 |

*Primary Examiner*—Richard L. Moses
*Attorney, Agent, or Firm*—Fay & Sharpe

[57] ABSTRACT

A disguised emergency light adapted to appear of a predetermined color when turned on and to appear other than the predetermined color when turned off. The light includes a light source substantially surrounded by surrounding means which includes color means of a predetermined color for imparting light of the predetermined color to light transmitted outwardly therethrough from the source, and disguise means closely adjacent the color means for outwardly transmitting light of the predetermined color therethrough when the light is turned on while blocking at least a substantial portion of the external light rays directed toward the color means from being imparted with the predetermined color when the light is turned off.

25 Claims, 9 Drawing Figures

DISGUISED EMERGENCY LIGHT

BACKGROUND OF THE INVENTION

This application relates to the art of lighting and, more particularly, to lights which are disguised to give the appearance of a standard light when turned off, and to provide light of a predetermined color for emergency signalling or the like when turned on. The invention is particularly applicable for use in lights of the type including a relatively small light source mounted at the base of a reflector having a reflector side wall extending outwardly from the base toward a lens. However, it will be appreciated that the invention has broader aspects and may be used in other types of lights.

Obviously, virtually all lights have a different appearance when turned on from when they are turned off. The difference in appearance is usually one of brightness or color intensity. However, a person can usually tell the color a light will have when it is turned on from the appearance of the light when it is turned off.

For certain purposes, it is desirable that a light have a certain color when turned on which is not discernible when the light is turned off. For example, vehicles used for what is known as undercover law enforcement operation frequently require emergency lights of any suitable emergency color, such as red or blue. When the emergency lights are off, it is desirable that the vehicle have the appearance of a standard family automobile or the like. These vehicles, as well as private vehicles used by auxiliary firemen or policemen, often require emergency lights for use when the vehicle is speeding to the scene of a fire, accident or crime, and it is desirable that the emergency lights not be recognizable as such when they are turned off. For vehicles of this type, it has become known to mount the emergency lights in the same location as conventional driving lights or fog lights, and to disguise the emergency lights so they will have the appearance of standard clear driving lights or yellowish fog lights when they are turned off.

Known arrangements for disguising emergency lights include that disclosed in U.S. Pat. No. 2,907,249 issued Oct. 6, 1959, to Hjermsted. In this arrangement, the entire lens is colored for imparting a color to light transmitted outwardly therethrough from a light source. The exterior surface of the lens is intermittently coated to provide a fragmentary mirror so that external light striking the fragmentary mirror will be reflected before it is imparted with the color of the lens. Arrangements of this type are very expensive because the entire exterior surface of a relatively large lens must be mirrored and the colored lens itself is of special construction. In addition, a large amount of light passes through the openings between the intermittent mirrored surface, and is reflected back out through the colored lens so that a complete disguise is not achieved. The inability to view through the lens is an indication in itself that the light is of special construction instead of being an ordinary clear driving light or fog light.

U.S. Pat. No. 3,514,589 issued May 26, 1970, to Huber discloses a disguised vehicle light having an outer panel which is adapted to appear the same as the finish of the car when the light is turned off. In the Huber arrangement, the color filter is positioned substantially completely across the reflector in front of the light source and a disguise panel is located across the light outwardly of the color filter. This arrangement itself would also give an indication of something special about the vehicle because the light would not appear to be a standard clear white driving light or a slightly yellowish fog light when turned off. The intensity of the light when turned on would also be less than that desired for an emergency light. Huber coats the exterior of a screen with a desired color and either incorporates it within another panel or positions the screen behind the panel. External light rays striking the colored outer surface of the screen will give the light the appearance of the color provided on the outer screen surface. In arrangements of this type, as well as that of Hjermsted, the lights themselves are relatively unconventional because a special outer lens or panel is required across the entire outer surface of the reflector. In addition, the disguise is easily discernible to a knowledgeable person because the interior of the light assembly cannot be seen from a location exterior of the lens. External light entering the light assemblies of Huber and Hjermsted is bound to be reflected back out through the color filter so that the disguise may be relatively incomplete.

It would be desirable to have a disguished emergency light which would give off a clear emergency color when illuminated, and would appear to be a conventional vehicle light when turned off.

BRIEF DESCRIPTION OF THE INVENTION

An inexpensive disguised emergency light includes a light source closely surrounded by surrounding means including a peripheral wall and an end wall. The surrounding means includes color means of a predetermined color for imparting the predetermined color to light transmitted outwardly therethrough from the light source. The surrounding means further includes disguise means for outwardly transmitting light of the predetermined color therethrough from the light source, and for blocking at least a substantial portion of external light rays directed toward the color means from being imparted with the predetermined color when the light source is turned off.

In the arrangement of the present invention, a relatively small light source is very closely surrounded by a surrounding means which includes the color means and the disguise means. Therefore, complete blockage of external light directed toward the light source does not occur closely adjacent the outer lens as in prior devices, and the light appears substantially like a conventional clear vehicular driving light or a yellowish fog light.

In light of the present invention, the surrounding means which provides the color means and the disguise means is very small and inexpensive so that a very low cost disguised emergency light is provided.

The improved disguised emergency light of the present invention may take many forms, and the light source itself may be a tungsten filament, a quartz halogen lamp, a strobe light, or a conventional light bulb including a filament enclosed within an envelope. Where the light source is of the bulb type, the envelope itself may comprise a part of the surrounding means.

In one arrangement, the surrounding means includes a plurality of spaced-apart light absorbing baffles extending inwardly therefrom toward the light source for absorbing external light rays passing through the surrounding means toward the light source and preventing outward reflection thereof after being imparted with the predetermined color by the color means.

In accordance with another aspect of the invention, a coating is provided on the color means for blocking external light rays from being imparted with the predetermined color by the color means. At least portions of the coating may be reflective or absorptive.

The coating for blocking at least a substantial portion of external light rays may be in the form of a supplemental mental grid-like member positioned around the color means for transmitting light outwardly through openings therein, and for absorbing or reflecting external light rays striking same between the openings.

The improved disguised arrangements of the present application can be used with relatively inexpensive lights of the type which can be disassembled in a manner similar to a flashlight by removing a circumferential closure which frees the front lens, reflector and light bulb. The disguise means of the present invention can be added to such existing lights, or can be incorporated in sealed-beam lights, or lights of other construction.

In a preferred arrangement, the light includes a housing having a dished reflector including a base and a reflector side wall extending outwardly therefrom toward a clear light transmitting lens. The surrounding means which provides the color means and disguise means is also mounted adjacent the base of the reflector in close surrounding relationship to the light source.

It is a principal object of the present invention to provide an improved disguised emergency light which is very inexpensive to manufacture.

It is also an object of the invention to provide an improved disguised emergency light whose degree of disguise can be varied by adding or substracting certain disguise elements.

It is a further object of the invention to provide an improved disguised emergency light which appears to be of a clear white construction or yellowish fog light construction when turned off, and which appears as a very bright emergency color such as red or blue when turned on.

BRIEF DESCRIPTION OF THE DRAWINGS

The invention may take form in certain parts and arrangements of parts, a preferred embodiment of which will be described in detail in this specification and illustrated in the accompanying drawings which form a part hereof and wherein.

DESCRIPTION OF PREFERRED EMBODIMENTS

Figure 1:
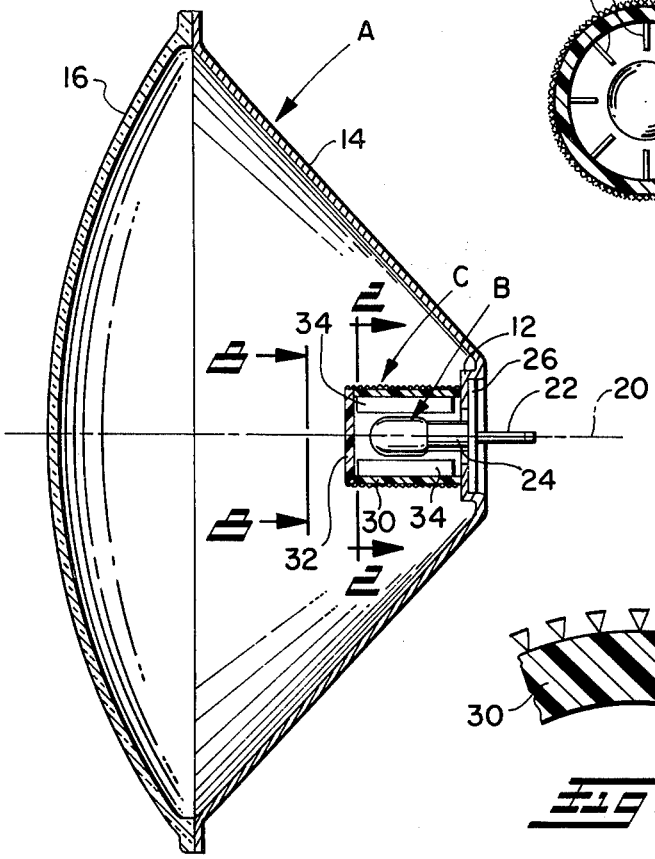
FIG. 1 is a cross-sectional elevational view of a light constructed in accordance with the present invention.

Referring now to the drawings, wherein the showings are for purposes of illustrating preferred embodiments of the invention only and not for purposes of limiting same, FIG. 1 shows a housing including a dished reflector A having a base 12 and a side wall 14 extending outwardly from base 12 toward lens 16 which is mounted opposite from base 12 in spaced relationship thereto. Obviously, the housing and its parts may take many forms. Reflector A may be of a polished metal or a reflector of metal, plastic or glass having a highly relfective coating on the interior surface thereof. In addition, reflector A may be in many shapes including generally conical or parabolic.

In one arrangement, a relatively small light source B is mounted adjacent to reflector base 12 on a longitudinal axis 20. Light source B may take many forms, including a tungsten filament surrounded by a clear light transmitting envelope, a quartz halogen light, a strobe light, or an open filament. In a preferred arrangement, reflector side wall 14 and lens 16 are generally symmetrical about longitudinal axis 20. Lens 16 is preferably of clear glass or plastic such as acrylic or polycarbonate, and normally has ridges or grooves formed therein for dispersing light rays directed outwardly therethrough from light source B, while scattering external light rays directed therethrough toward light source B.

The light of FIG. 1 may take many forms, and may be of the type which is easily disassembled and reassembled by having electrical contacts 22 which plug into a socket and being connected with a receptacle 24 for receiving the base on a light bulb forming light source B. This arrangement would be similar to a flashlight or the like wherein a circumferential member is removably secured to a cooperating member on the vehicle or on an external housing part surrounding reflector A for holding lens 16 against the outer periphery of reflector A, and also biasing base 12 against an outwardly extending flange 26 integral with base 24. In such an arrangement, removal of the circumferential member would allow quick disassembly of lens 16 for providing access to the interior of the reflector and adding the disguise means of the present application thereto. However, it will be appreciated that the improved disguise means can be used with original manufactured lights of the sealed-beam type, as well as other lights.

In one arrangement, surrounding means C closely surrounds light source B adjacent base 12 of reflector A for providing color means and disguise means. In a preferred arrangement, surrounding means C includes a peripheral wall surrounding light source B outwardly of longitudinal axis 20 as shown in FIG. 1, and located between light source B and reflector side wall 14. Surrounding means C also includes an end wall located between light source B and lens 16.

In one arrangement, surrounding means C includes color means 30 in the form of a light transmitting translucent color filter which may be of any predetermined color such as red or blue. Color means 30 peripherally surrounds light source B and may also include a color filter end wall 32 located between light source B and lens 16.

Figure 2:
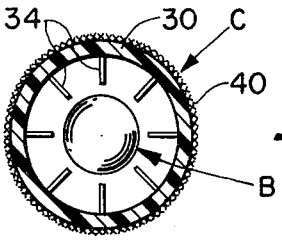
FIG. 2 is a cross-sectional elevational view taken generally along lines 2—2 of FIG. 1.

As shown in FIG. 2, the peripheral wall of surrounding means C includes a generally cylindrical member 30 provided with a predetermined color other than clear or white, or black, and may be of red or blue. Peripheral wall 30 may be glass or plastic member having the predetermined color incorporated therein, or coated on a surface thereof.

It will be recognized that peripheral wall 30 may take many forms and is shown as being generally cylindrical only for purposes of illustration. For example, peripheral wall 30 may be of virtually any geometric shape or combinations. Examples include square, rectangular, triangular, polygonal or combinations thereof. In addition, peripheral wall 30 is shown as having a uniform circumference along its entire length. Obviously, peripheral wall 30 of any of the described shapes may be sloped inwardly toward axis 20 from reflector base 12 toward surrounding end wall 32, or may be sloped toward axis 20 in a direction from end wall 32 toward base 12. In such arrangements, surrounding peripheral wall 30 could be of truncated conical or polygonal shape with its small end located either at base 12 or end wall 32. Also, such shapes could come to a relatively sharp point instead of being truncated.

Surrounding means C, and particularly peripheral wall 30 thereof, may be secured to the inner surface of reflector base 12 by suitable adhesive or by mechanical fasteners. A plurality of circumferentially-spaced light absorbing baffles 34 extend inwardly from the inner surface of peripheral wall 30 toward light source B and longitudinal axis 20. The number of light absorbing baffles 34 provided will depend upon the shape of light source B and peripheral wall 30. Such baffles 34 may number anywhere from two to 12 or more. Baffles 34 are preferably flat and extend generally radially toward longitudinal axis 20 so that radical light rays transmitted from light source B freely pass outwardly between the baffles. Baffles 34 may be of any suitable material which is coated black, or may be of a black material such as plastic. The baffles may be adhesively bonded to the inner surface of peripheral wall 30 or could be molded integrally with peripheral wall 30 and then coated with a light absorbing coating.

Closely surrounding peripheral wall 30 of surrounding means C is disguise means generally indicated at 40 in FIG. 2.

Figure 3:
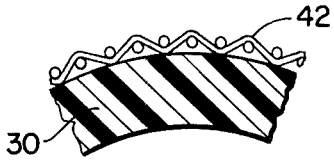
FIG. 3 is a partial cross-sectional elevational view similar to FIG. 2 and showing a specific coating or disguise means on the outer surface of a light transmitting color filter.

This disguise means may take many forms, and only a few of the forms will be specifically referred to. In one arrangement, the coating 40 of FIG. 2 is in the form of a metal mesh screen, such as stainless steel, shown at 42 in FIG. 3. Screen 42 may be loosely positioned around peripheral wall 30, or may be adhesively secured thereto or to base 12. Screen 42 has a plurality of spaced-apart openings therein, and blocking surfaces located between such openings for blocking external light rays from passing through peripheral wall 30. The outer surface of screen 42 may be painted black or lightly yellow, or may simply be silver. In other words, the outer blocking surface may be light absorptive or reflective, and may reflect a different color light than the predetermined color of filter 30.

Figure 4:
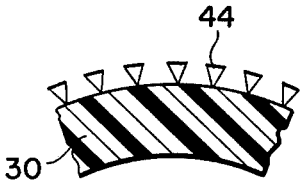
FIG. 4 is a view similar to FIG. 3 and showing another form of disguise means.

FIGS 4–7 show other arrangements for the coating. FIG. 4 shows a formed metal member generally indicated at 44 surrounding peripheral wall 30. Member 44 may be of formed metal having a plurality of spaced-apart punched openings therein to leave the metal between the openings of generally triangular cross-sectional shape as shown in FIG. 4. The flat outer surfaces of the metal member would define the blocking means for either absorbing or reflecting external light rays striking same.

Figure 5:
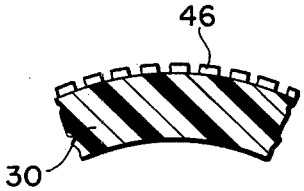
FIG. 5 is a view similar to FIGS. 3 and 4, and showing another form of disguise means.

FIG. 5 shows a member 46 provided with a plurality of spaced-apart openings both longitudinally and circumferentially of peripheral wall 30. Light is freely transmitted outwardly through the openings, while external light rays striking the surface of member 46 between the openings is absorbed or reflected before being imparted with the predetermined color of filter 30.

Figure 6:
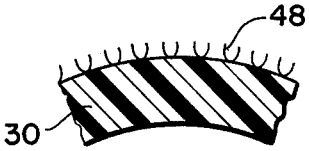
FIG. 6 is a view similar to FIGS. 3–5 and showing another form of disguise means.

FIG. 6 shows another arrangement wherein a formed metal member 48 has a plurality of openings spaced longitudinally and circumferentially of peripheral wall 30, and is generally U-shaped between the openings to provide a highly reflective or absorptive surface.

Figure 7:
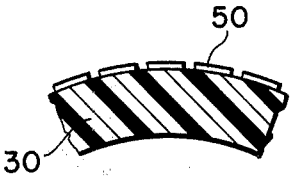
FIG. 7 is a view similar to FIGS. 3–6 and showing another form of the disguise means.

FIG. 7 shows another arrangement wherein a coating 50 is provided directly on the outer surface of peripheral wall 30. Coating 50 may comprise a plurality of circumferentially and longitudinally-spaced strips of mirror-like material, or may take many other forms. Coating 50 may be in the form of a one-way mirror coating for freely transmitting a substantial portion of light outwardly therethrough, while reflecting a substantial amount of external light. Coating 50 may also be in the form of a dichronic coating for transmitting light of a predetermined color outwardly therethrough from light source B, while reflecting a substantial portion of external light.

Figure 8:
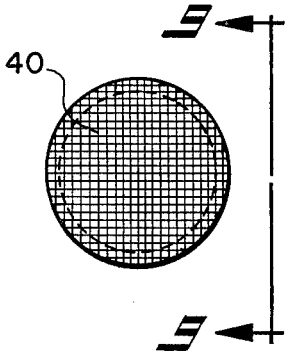
FIG. 8 is an end elevational view of a surrounding means taken generally along lines 8—8 of FIG. 1; and, FIG. 9 is a side elevational view taken generally along lines 9—9 of FIG. 8.
Figure 9:
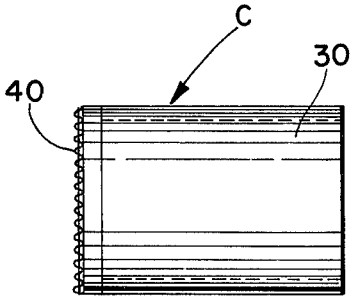

Obviously, many different arrangements are possible in accordance with the aspects of the present invention. Surrounding means end wall 32 may be a color filter for transmitting light therethrough and have a coating 40 as shown in FIG. 8 corresponding to any of the embodiments of FIGS. 3–7. In addition, it is possible to make end wall 32 of surrounding means C of a material which does not transmit light, and to provide a reflective coating on its interior surface so that light striking same from light source B will be reflected back toward light source B for transmission outwardly through the peripheral wall of surrounding means C. It is also possible to provide surrounding means C with an end wall 32 which is painted black, silver or yellowish on its outer surface. Various combinations of light blocking surfaces may be used on peripheral wall 30 and end wall 32. For example, end wall 32 may be painted black to be light absorptive, while peripheral wall 30 is a translucent color filter and has an outer disguise means which is reflective. Likewise, the disguise means provided by any of the coatings of FIGS. 3–7 may be painted black on their outer surfaces, or provided with a highly reflective surface which may have a color different from the color of color filter 30. The interior surfaces of the disguise means may be highly reflective to help bounce light rays out through the openings. Where end wall 32 is light transmissive of a predetermined color the same as peripheral wall 30, the coating 40 may take any of the forms of FIGS. 3–7 and may have an outer black surface, while the outer surface of the disguise means surrounding peripheral wall 30 is silver or yellowish. A black coating on the end wall appears like a conventional guard for the light source.

In certain arrangements, it is possible to omit an end wall 32 on a separate surrounding means C so that surrounding means C would include the end portion of the envelope surrounding the filament of light source B. In fact, it is possible to omit separate surrounding means C when light source B is a bulb by providing the envelope of the bulb with a predetermined color around its periphery, while its end portion facing toward lens 16 may be black. A mirror-like coating or the disguise means of FIGS. 3–7 may then be provided around the periphery of the envelope itself. Obviously, the disguise means of FIGS. 3–7 could also be provided on the end portion of the bulb envelope, and the exterior surfaces of the envelope peripheral portion and end portion could be of different light blocking or transmitting characteristics.

In the arrangement of the present application, various of the features are useable independently of one another depending upon the degree of disguise desired. Where very little disguise is necessary, it is possible to omit baffles 34, and to provide a one-way mirror coating on the translucent colored walls 30 and 32. Where the light is disguised as a conventional yellowish appearing fog light, the coating 40 of FIG. 8 could have a black outer surface to appear as a conventional guard, while the outer surface of the coating 40 in any embodiment of FIGS. 3–7 would be slightly yellowish light reflecting.

By way of one example, it may be assumed that peripheral wall 30 and end wall 32 of surrounding means C are red for imparting a red color to white light transmitted outwardly therethrough from clear light source B. Such light is reflected from the highly reflective interior surface of reflector side wall 14 and dispersed through clear lens 16. External light entering the housing from outside lens 16 is directed toward the color means both directly and by reflection off side wall 14. The disguise means of FIGS. 3–7 blocks a substantial portion of the external light rays from being imparted with the predetermined color of color means 30 or 32 by blocking those rays from passing through the color means. Those light rays which do pass through the color means are intercepted and absorbed by baffles 34. The disguise means placed peripherally around light source B can have different characteristics from the disguise means placed between light source B and lens 16 as previously explained. End wall 32 can be provided with a reflective or absorbing surface. The light blocking surface of the disguise means on either end wall 32 or peripheral wall 30 can be light absorptive of light reflecting. Preferably, the coatings shown in FIGS. 3–7 provide an outer disguise surface which is spaced outwardly away from the outer periphery of either peripheral wall 30 or end wall 32. This blocks a substantial portion of external light rays well before they approach the color means. Naturally, it is possible to omit end wall 32 of surrounding means C and to simply provide a disguise means on the end portion of light source B itself, or to provide light source B with a light blocking coating directly on its end portion.

The disguise means provided by the coating or grid-like members surrounding the light source may have any desirable outer coating including black, silver or yellowish.

In previous disguised lights, beam splitters or one-way mirrors have been used to provide disguise by preventing external lights from being bounced off the reflector behind the lens. In the present invention, external light entering lens 16 uses reflector A itself to direct external light rays for reflection or absorption by the disguise means closely surrounding the light source to make the light appear other than the predetermined color provided when the light is turned on.

Although light source B of FIG. 1 is shown as a light bulb having an axis coincidental with axis 20, it will be recognized that the light source could be mounted in side wall 14 closely adjacent base 12. In such an arrangement, axis 20 would simply be the axis of the light and the light source would not have an axis coincidental with axis 20. Peripheral wall 30 would than have an opening therein through which the light source projects into surrounding means C.

Where the light source is otherwise mounted in a light or housing of the type not having a longitudinal axis as such, the surrounding means would be mounted in surrounding relationship to the longitudinal axis of the light source itself.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

Having thus described my invention, I now claim:

1. A light adapted to appear of a predetermined color when turned on and to appear other than said predetermined color when turned off comprising; a light source, surrounding means closely surrounding said light source and including a peripheral wall and an end wall positioned in the path of light rays transmitted outwardly from said light source, said surrounding means including light transmitting color means of a predetermined color for imparting said predetermined color to light transmitted outwardly therethrough from said light source when said light source is turned on, and said surrounding means including disguise means surrounding said color means for outwardly transmitting light of said predetermined color therethrough when said light source is turned on and for blocking at least a substantial portion of external light rays directed toward said color means from being imparted with said predetermined color when said light source is turned off.

2. The light of claim 1 wherein at least a portion of said disguise means is reflective of external light rays for blocking such rays striking same from being imparted with said predetermined color by said color means.

3. The light of claim 1 wherein at least a portion of said disguise means is absorptive of external light rays for blocking such rays striking same from being imparted with said predetermined color by said color means.

4. The light of claim 1 wherein said disguise means is absorptive of external light rays directed toward said end wall of said surrounding means and reflective of external light rays directed toward said peripheral wall of said surrounding means.

5. The light of claim 1 wherein said color means has an outer surface and said diguise means includes an outwardly facing blocking surface spaced outwardly from said outer surface for blocking external light rays striking same from being imparted with said predetermined color by said color means.

6. The light of claim 5 wherein at least a portion of said blocking surface is reflective.

7. The light of claim 1 wherein said disguise means includes a grid-like member having a plurality of spaced-apart openings through which light is outwardly transmitted from said light source and having an outwardly facing blocking surface between said openings for blocking external light rays striking same from being imparted with said predetermined color by said color means.

8. The light of claim 1 wherein said disguise means includes spaced-apart light absorbing baffles extending inwardly of said surrounding means toward said light source for absorbing external light rays passing through said color means.

9. The light of claim 1 wherein said disguise means includes a coating on said color means for blocking external light rays striking same from being imparted with said predetermined color by said color means.

10. The light of claim 1 wherein said end wall of said surrounding means is not outwardly transmissive of light from said light source and has a reflective inner surface.

11. The light of claim 1 wherein said disguise means includes an end disguise portion for blocking external light rays striking same and directed toward said end wall of said surrounding means from being imparted with said predetermined color by said color means and a peripheral disguise portion for blocking external light rays striking same and directed toward said peripheral wall of said surrounding means from being imparted with said predetermined color by said color means, and said end disguise portion and said peripheral disguise portion having different light ray blocking characteristics.

12. The light of claim 11 wherein one of said disguise portions is reflective of external light rays striking same and the other of said disguise portions is absorptive of external light rays striking same.

13. The light of claim 1 including a housing having a dished reflector including a base and a light transmitting lens opposite from said base, and said light source and surrounding means being mounted adjacent said base.

14. The light of claim 1 wherein said color means is located only on said peripheral wall of said surrounding means.

15. The light of claim 1 wherein said light source comprises a light bulb having a filament surrounded by a clear light transmitting envelope, and said surrounding means surrounds said envelope.

16. The light of claim 1 wherein said light source comprises a light bulb having a filament surrounded by an envelope and said envelope forms at least a portion of said surrounding means.

17. The light of claim 1 wherein said light source comprises a light bulb having a filament surrounded by a clear envelope, and said surrounding means is completely separate from said envelope and closely surrounds same in slightly outwardly-spaced relationship thereto.

18. The light of claim 1 wherein said light is positioned on a longitudinal axis for transmitting light generally outwardly of and generally parallel to said axis, said peripheral wall being positioned in the path of light rays transmitted generally outwardly of said axis from said light source, said end wall being positioned in the path of light rays transmitted generally parallel to said axis.

19. A light adapted to appear of a predetermined color when turned on and to appear other than said predetermined color when turned off comprising; a housing including a dished reflector having a base, said housing including a light transmitting lens opposite from said base in spaced relationship thereto, said reflector having a side wall extending from said base toward said lens, a light source mounted in said housing adjacent said base, surrounding means closely surrounding said light source and including a peripheral wall positioned between said light source and said reflector side wall and an end wall positioned between said light source and said lens, said surrounding means including light transmitting color means of a predetermined color for imparting said predetermined color to light transmitted outwardly therethrough from said light source when said light source is turned on, and said surrounding means including disguise means closely adjacent said color means for outwardly transmitting light of said predetermined color therethrough when said light source is turned on and for blocking at least a substantial portion of external light rays entering said housing through said lens and directed toward said color means from being imparted with said predetermined color when said light source is turned off.

20. The light of claim 19 wherein said light source comprises a filament enclosed within a clear envelope, and said color means including a color filter extending at least along said peripheral wall of said surrounding means.

21. The light of claim 20 wherein said disguise means includes a coating on said color means for outwardly transmitting light of said predetermined color therethrough when said light source is turned on and for blocking external light rays striking same from being imparted with said predetermined color by said color means.

22. The light of claim 21 wherein said coating includes a grid-like member having plurality of openings through which light of said predetermined color is outwardly transmitted and having a blocking surface between said openings for blocking external light rays striking same from being imparted with said predetermined color.

23. The light of claim 19 wherein said color means is coextensive with said peripheral wall of said surrounding means, and a plurality of spaced-apart light absorbing baffles extending inwardly from said color means toward said light source.

24. A light which appears of a predetermined color when turned on and appears other than said predetermined color when turned off comprising; a light source mounted in a housing having a light transmitting lens through which light is outwardly transmitted from said housing when said light source is turned on and through which the interior of said housing is visible from outside thereof when said light source is turned off, light transmitting color means of a predetermined color positioned within said housing in spaced relationship to said lens and closely adjacent said light source for imparting light transmitted outwardly therethrough from said light source with said predetermined color, and disguise means positioned within said housing closely adjacent said color means for transmitting light of said predetermined color outwardly therethrough and for blocking a substantial portion of external light rays entering said housing through said lens from being imparted with said predetermined color by said color means.

25. A light adapted to appear of a predetermined color when turned on and to appear other than said predetermined color when turned off comprising: a light source mounted in a housing having a light transmitting lens through which light is outwardly transmitted from said housing when said light source is turned on and through which the interior of said housing is visible from outside thereof when said light source is turned off, said light source being mounted adjacent said lens; light transmitting color means of a predetermined color positioned closely adjacent said light source for imparting light transmitted outwardly therethrough from said light source with said predetermined color; disguise means positioned closely adjacent said color means for transmitting light of said predetermined color outwardly therethrough and for blocking a substantial portion of external light rays entering said housing through said lens from being imparted with said predetermined color by said color means; and, a dished reflector having a base and a side wall extending outwardly from said base toward said lens, said color means and disguise means being mounted closely adjacent said reflector base so that a substantial portion of at least said reflector side wall is visible through said lens from outside of said housing.

* * * * *